United States Patent [19]

Güttinger

[11] 4,414,889

[45] Nov. 15, 1983

[54] ROLLING DEVICE

[75] Inventor: Heinz Güttinger, Winterthur, Switzerland

[73] Assignee: Escher Wyss Limited, Zurich, Switzerland

[21] Appl. No.: 276,534

[22] Filed: Jun. 23, 1981

[30] Foreign Application Priority Data

Aug. 14, 1980 [CH] Switzerland ..... 6133/80

[51] Int. Cl.[3] ..... B30B 3/04

[52] U.S. Cl. ..... 100/162 B; 29/116 AD; 72/241; 72/245

[58] Field of Search ..... 100/162 R, 162 B, 161, 100/176, 160; 72/241, 243, 245, 246; 29/116 AD, 116 R

[56] References Cited

U.S. PATENT DOCUMENTS

| | | | |
|---|---|---|---|
| 3,171,305 | 3/1965 | Stone | 72/241 |
| 3,416,341 | 12/1968 | Dey et al. | 72/245 |
| 3,518,858 | 7/1970 | Kamata | 72/245 X |
| 3,531,960 | 10/1970 | Stone | 100/162 B X |
| 3,596,488 | 8/1971 | Bond | 72/245 X |
| 4,218,905 | 8/1980 | Lehmann | 72/245 X |
| 4,222,255 | 9/1980 | Lehmann | 72/243 X |
| 4,319,522 | 3/1982 | Marchiorio | 72/245 X |

*Primary Examiner*—Peter Feldman

*Attorney, Agent, or Firm*—Robert A. Ostmann

[57] ABSTRACT

A rolling device is shown, having two press rollers of which at least one is a deflection equalizing roller. The equalizing roller has a support, support elements and a roller shell rotating around the support which is displaceable relatively to the support in a plane containing the axes of the rolls.

In order to reduce the deflection of the supports under the stress produced during use by the support elements the supports are secured in the side panels and without clearance, stiffened against bending.

Therefore, the supports and both the side panels form together a force locked construction being firm against bending.

8 Claims, 3 Drawing Figures

ROLLING DEVICE

BACKGROUND OF THE INVENTION

The invention relates to a rolling device with a roller stand and two pressrollers, one of which at least has an axial support, around which a roller shell is pivoted, and which lies on the support on movable support elements, and is displaceable relative to the axial support in a plane containing the axes of the rolls.

A rolling device such as this is known, for example, from U.S. Pat. No. 3,921,514. When in use, the support of the deflection equalizing roll, provided with support elements, deflects under the stress produced by the support elements. Spherical bearing boxes provided between the support and the stand allow the support to deflect unimpeded. The deflection of the support causes a large clearance between the roller shell and the support, since the roller shell of the deflection equalizing roll remains straight during the entire rolling operation.

SUMMARY OF THE INVENTION

The invention is based on the problem of reducing the deflection of the support under stress, in a rolling device of the type mentioned in the introduction.

For this rolling device, the problem is solved according to the invention, in that the axial support, or the support and the shaft of the second pressroller are secured in the side panels of the roller stand stiffened against bending and without clearance to form together a force locked construction of the axial supports, respectively support and shaft, and the both side panels, being firm against bending.

In this way a smaller deflection of the support is achieved, so that smaller roll diameters, or greater rolling strengths for the same diameter, are possible.

The rigidity of the roll stand is increased, if the supports are secured, stiffened against bending, by means of a double bracing, consisting of braces in the side panels of the rolling stand, and of an additional brace slid axially in the direction of the support axes.

The deflection of the support can be variable, if the additional braces are adjustable.

BRIEF DESCRIPTION OF THE DRAWING

In the drawings, which illustrate the invention, example embodiments of the object of the invention are shown in simplified form, showing.

DESCRIPTION OF THE PREFERRED EMBODIMENT

Figure 1:
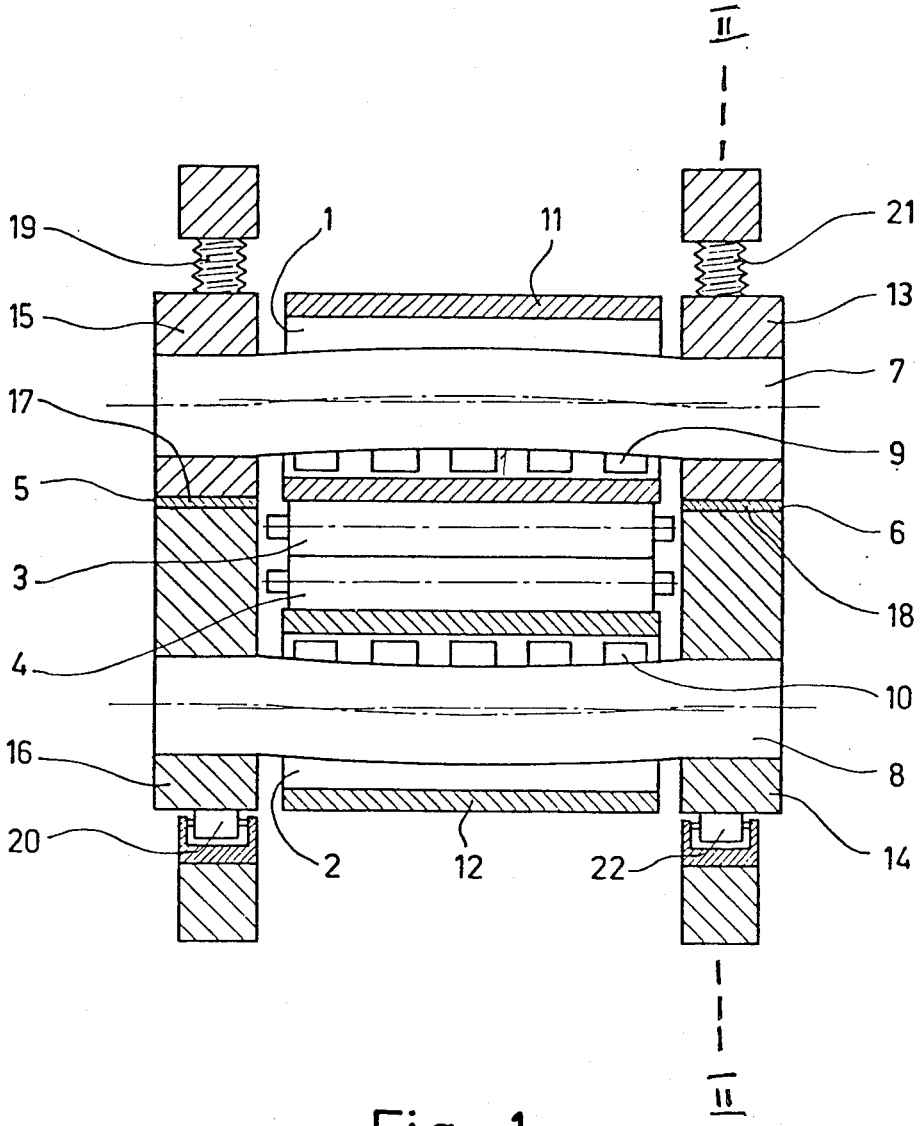
FIG. 1 a section through a diagrammatic example embodiment of a rolling device according to the invention, through the support axes, FIG. 2 a section of the rolling device along the line II—II in FIG. 1, FIG. 3 a section through a further example embodiment, through the support axes.

In each of the example embodiments, the same parts are provided with the same reference numbers. The rolling device shown in FIGS. 1 & 2, namely a four-roller rolling mill, suitable for example for rolling thin steel strips, has two deflection equalizing rolls 1, 2 between which there are two full working rolls 3, 4 of smaller diameter. The deflection equalizing rolls 1, 2 which act as support rolls on the working rolls 3, 4 each have a support 7, 8 fixed in side panel 5, 6 stiffened against bending and without clearance and stationary, and around which a roller shell 11, 12 rotates, resting on support elements 9, 10.

At least one of the deflection equalizing rolls 1 or 2 has a roller shell 11 or 12 being displaceable relatively to the axial support 7 or 8 in a plane containing the axes of the rolls 1 and 2.

The side panels 5, 6 each have two blocks 13, 14; 15, 16 between which clamping washers 17, 18 are provided.

According to the material to be rolled, the clamping washers 17, 18 can be substituted by other washers of larger or smaller thickness. The stress exerted by the screws 19, 21 or beams 20, 22 onto the side panels 5, 6 must be so great that the blocks 13, 14 and the clamping washer 17, or the blocks 15, 16 and the clamping washer 18, lie rigidly on top of each other in every phase of operation. The clamping, stiffened against bending, considerably impedes a deflection of the supports 7, 8 under the stress produced during use by the support elements. As shown in FIG. 1, the peripheral parts of the supports remain in the first instance fairly parallel to the rolling axis, and only deflect away from the axis towards the center of the roll, as is shown, greatly exaggerated, in FIG. 1. These smaller deflections from a straight line on the part of the support allow a smaller height of lift of the support elements, and also a smaller clearance between the roller shell and support.

Figure 2:
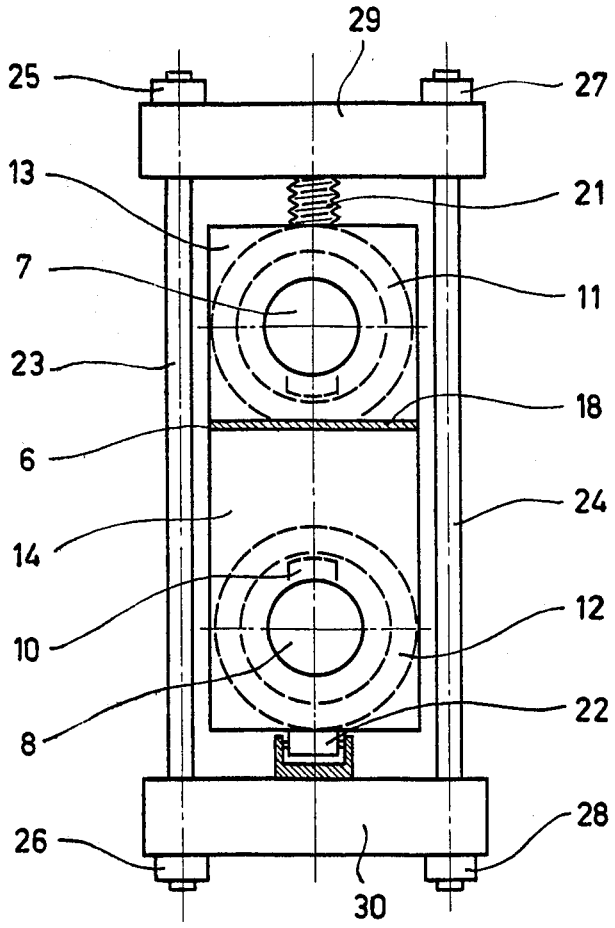

Through tie rods 23, 24 shown in FIG. 2, which are passed through cross beams 29, 30 blocks 13 and 14 of the side panel 6 are pressed together by means of screws 25–28. The extent of the initial stress is set by beam 22, according to which the screw 21 is adjusted, and the suitable clamping washer 18 is selected.

Figure 3:
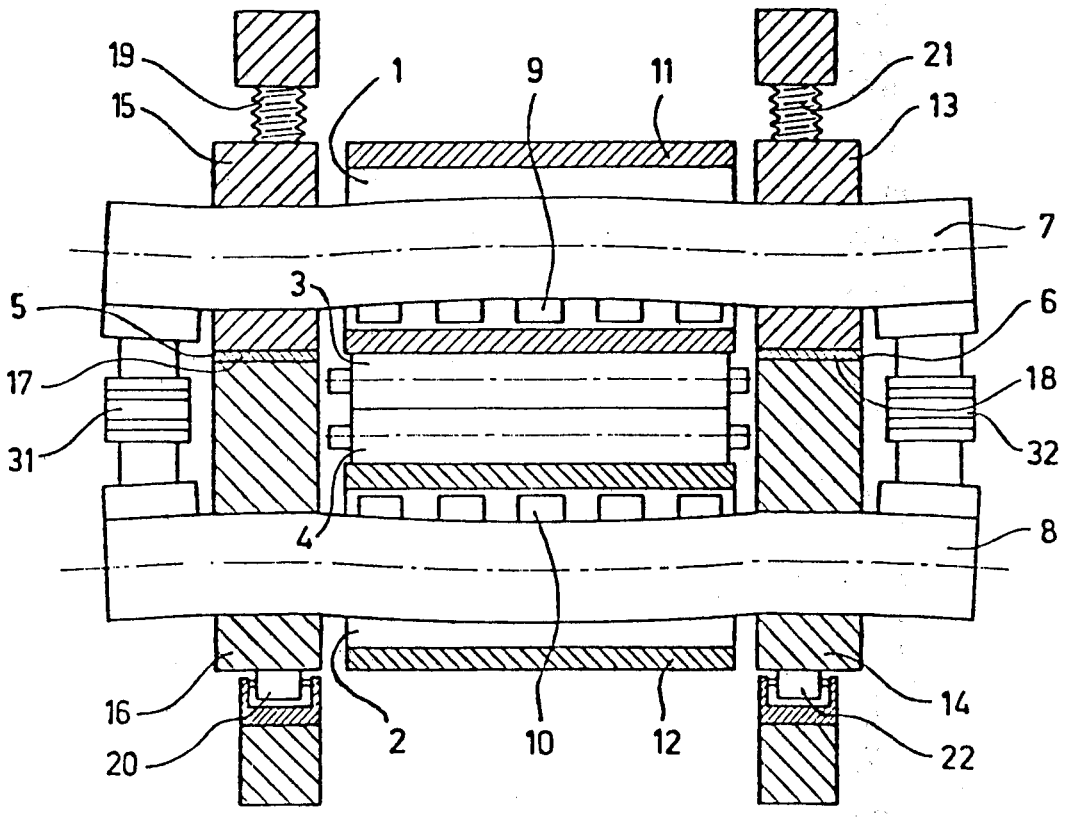

In the rolling device shown in FIG. 3, compared with the example embodiment described in FIGS. 1 and 2, the supports 7 and 8 have laterally extended ends, between which pistons 31, 32 are fitted. These pistons, 31, 32 when in use, press the support ends apart. In this way it is possible to bend the centers of the supports 7, 8 towards the working rollers 3, 4 such that they are equalized by the deflections generated by the support elements 9, 10. In use, through controlling the opposed stress in the same direction, coming from the pistons 31, 32 supports 7, 8 maintain an essentially straightlined shape. The bending of the supports in the opposite direction to the bending caused by elements support 9, 10 functions best through pistons 31, 32 if these are essentially controlled identically to the support elements 9, 10.

The increase in rigidity of the support, which can be achieved in all the various embodiments of the present invention, has many advantages, both for the design of the deflection equalizing rollers themselves, of the type described here, and also for the structure as a whole:

If the rolling device is integrated into a highspeed automatic gauge control system, the rigidity of the structure plays a decisive role as regards the dynamic range which can be achieved. The rolling device according to FIG. 1 brings about a considerable strengthening of the structure, and the rolling device according to FIG. 3 offers the further possibility of inducing part of the capacity needed for highspeed control, via pistons 31, 32. This brings about considerable constructional advantages, as it is easier to place the necessary hydraulic auxiliary installations near to the pistons 31, 32 than near to support elements 9, 10.

As a result of the greater rigidity of the rolling stand, the support can be designed with a smaller diameter, with the consequence that the roller diameter can also be designed smaller. This, in turn, means that the entire structure can be designed smaller, without any loss of rigidity. According to the particular application, the savings on space and materials can be quite considerable.

I claim:

1. A rolling device comprising a roller stand and two press rollers mounted on parallel axes between side panels of the stand, at least one of which rollers has an axial support with support elements upon which a roller shell is rotatable about the support, the roller shell being displaceable relative to the axial support in the plane containing the roller axes, wherein the axial support of said one roller extends beyond both ends of the shell and has portions fixed in the side panels so as to be immovable with respect to the panels, whereby the side panels and the support portions form a force-locked construction which gives to the support the character of a beam with fixed ends and thereby enhances the bending resistance of the support.

2. A rolling device according to claim 1, wherein the other of said two rollers has a shaft which, beyond both ends of the roller, includes portions fixed in the side panels so as to be immovable with respect to the panels and forming part of said force-locked construction, whereby the shaft of said other roller also has the character of a beam with fixed ends and its bending resistance is enhanced.

3. A rolling device according to claim 2, wherein said other roller has a axial support with support elements upon which a roller shell is rotatable about the support, said axial support constituting said shaft secured in the side panels.

4. A rolling device according to any preceding claim wherein the axial support is braced in the side panels and wherein the support extends at both sides beyond the side panels, an additional brace being located between each extended support and an extended shaft or support part of the other of said rollers.

5. A rolling device according to claim 4 wherein said additional braces are adjustable.

6. A rolling device according to claim 5 wherein each said additional brace comprises a piston-cylinder mechanism, and a source of fluid under pressure.

7. A rolling device according to claim 6 wherein adjustment of said additional brace is controlled in accordance with operation of the support elements.

8. A rolling device according to claim 7 wherein the support elements are controlled from the same said source of fluid under pressure.

* * * * *